US008499564B2

(12) United States Patent
Martin et al.

(10) Patent No.: US 8,499,564 B2
(45) Date of Patent: Aug. 6, 2013

(54) PILOT BURNER FOR GAS TURBINE ENGINE

(75) Inventors: Scott M. Martin, Titusville, FL (US); Robert J. Bland, Oviedo, FL (US); Anil Gulati, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 1356 days.

(21) Appl. No.: 12/233,713

(22) Filed: Sep. 19, 2008

(65) Prior Publication Data

US 2010/0071373 A1 Mar. 25, 2010

(51) Int. Cl.
*F02C 7/264* (2006.01)

(52) U.S. Cl.
USPC ..... 60/737; 60/748; 239/463; 239/413; 239/405

(58) Field of Classification Search
USPC ..... 60/737–740, 742, 746–748, 39.826; 239/407, 413, 416.4, 416.5, 418, 423, 463, 239/476–478, 486, 487, 398–400, 402, 403–405, 434.5
See application file for complete search history.

(56) References Cited

U.S. PATENT DOCUMENTS

| | | | | |
|---|---|---|---|---|
| 4,982,570 | A * | 1/1991 | Waslo et al. | 60/733 |
| 5,404,711 | A * | 4/1995 | Rajput | 60/39.463 |
| 5,735,681 | A | 4/1998 | Cheng | |
| 5,879,148 | A | 3/1999 | Cheng et al. | |
| 6,161,387 | A | 12/2000 | Green | |
| 6,543,235 | B1 * | 4/2003 | Crocker et al. | 60/776 |
| 6,848,260 | B2 | 2/2005 | North et al. | |
| 6,986,255 | B2 | 1/2006 | Smith et al. | |
| 7,360,363 | B2 * | 4/2008 | Mandai et al. | 60/737 |
| 2002/0043067 | A1 * | 4/2002 | Maeda et al. | 60/776 |
| 2004/0050056 | A1 * | 3/2004 | Pederson et al. | 60/737 |
| 2007/0033919 | A1 | 2/2007 | Tanimura et al. | |
| 2009/0223225 | A1 * | 9/2009 | Kraemer et al. | 60/723 |

* cited by examiner

*Primary Examiner* — Andrew Nguyen

(57) ABSTRACT

A pilot burner (150, 350) for a gas turbine engine delivers an inner non-swirling fuel-oxidant mixture surrounded by an outer swirling fuel-oxidant mixture, thereby providing enhanced mixing with no recirculation zone. At least one fluid-restricting inlet port (166, 366) provides an oxidant to an inner mixing passage (160, 360). The inner mixing passage (160, 360) includes a plurality of fuel outlets (168). An outer annular mixing passage (180) receives oxidant from an upstream port (181) surrounding the inner mixing passage and includes at least one swirler element (186, 386) and fuel outlets (188).

8 Claims, 3 Drawing Sheets

PILOT BURNER FOR GAS TURBINE ENGINE

FIELD OF INVENTION

The invention generally relates to a gas turbine engine, and more particularly to a pilot burner capable of achieving low-$NO_x$ emissions during operation.

BACKGROUND OF THE INVENTION

Combustion engines such as gas turbine engines are machines that convert chemical energy stored in fuel into mechanical energy useful for generating electricity, producing thrust, or otherwise doing work. These engines typically include several cooperative sections that contribute in some way to this energy conversion process. In gas turbine engines, air discharged from a compressor section and fuel introduced from a fuel supply are mixed together and burned in a combustor section. The products of combustion are directed through a turbine section, where they expand and turn a central rotor.

A variety of combustor designs exist, with different designs being selected for suitability with a given engine and to achieve desired performance characteristics. One popular combustor design includes a centralized pilot burner (hereinafter referred to as a pilot burner or simply pilot) and several main fuel/air mixing apparatuses, generally referred to in the art as injector nozzles, swirlers, main swirlers or main swirler assemblies, arranged circumferentially around the pilot burner. With this design, a central pilot flame zone and a mixing region are formed. The stream of mixed fuel and air flows out of the mixing region, past the pilot flame zone, and into a main combustion zone of a combustion chamber, where combustion occurs. Energy released during combustion is captured by the downstream components to produce electricity or otherwise do work.

During operation, the pilot burner selectively produces a stable flame that typically is anchored in the pilot flame zone, while the fuel/air mixing apparatuses produce a mixed stream of fuel and air in the above-referenced mixing region. In many designs of conventional pilot burners, the stabilization of the pilot flame is recognized to occur due to a strong, central recirculation zone. An undesired effect of the recirculation zone is the occurrence of regions of higher than average temperatures which result in relatively high levels of undesired combustion products, such as oxides of nitrogen ($NO_x$). Due to concerns and regulations about reduction of undesired emissions from gas turbines, a number of approaches have been taken toward reduction of such emissions while maintaining a suitable efficiency and stable combustion.

Among the approaches taken to address a balanced, low-$NO_x$ burner (also referred to by some as a nozzle) is an approach taught in U.S. Pat. No. 5,735,681. That patent teaches a fuel-air nozzle in which a premixed fuel-air mixture is swirled gently by low swirl jets of air introduced tangentially, upstream of the exit port of the fuel-air nozzle. As the fuel/air mixture moves downstream from the fuel nozzle, the flow stream diameter increases, the axial flow velocity decreases and the flame is stated to be positioned where the flame speed matches the flow rate of the fuel-air mixture. This is stated to occur without recirculation which would normally result in an anchoring of flame at a point near the fuel nozzle. The patent further states that "[b]ecause the fuel-air mixture is weakly swirled only at the outside edges of the burn zone, complete burning is possible and $NO_x$ emissions are minimized." U.S. Pat. No. 5,879,148 describes an another approach where a flow balancing insert in introduced into a central passage which surrounds an annular passage of a swirler to produce a stable flame without recirculation.

Despite such approaches in the art, there remains a need to develop an efficient and flexible pilot burner suitable for commercial gas turbine engines, and more particularly for lean premixed gas turbine engines.

BRIEF DESCRIPTION OF THE DRAWINGS

The invention is explained in following description in view of the drawings that show.

DETAILED DESCRIPTION OF EMBODIMENTS OF THE INVENTION

The present invention provides a flexible, superiorly controllable multi-passage pilot burner for gas turbine and other applications that may benefit from such pilot burner's low-$NO_x$ operation. To achieve this, various embodiments of the present invention include an inner and an outer mixing passage, each of these having separate inlets for a fluid oxidant, such as air, and separately controlled fuel outlets supplying fuel to the respective passages. The mixing of the fluid oxidant and fuel occurs in each respective mixing passage rather than at a common upstream locus. By providing for separate controls of fuel to each mixing passage, the pilot burners are considered to be fuel-profilable. Further, separate fluid oxidant flows are provided to the inner and outer mixing passages, and these flows may be modified in various embodiments through modifications at or near the entrances to the respective mixing passages to control flow velocity through the respective passage. Also, by appropriate design within the constraints of the features of the present invention, the flow of pre-mixed fuel/oxidant leaving the pilot burner diverges in a generally expanding conical flow pattern and there is no need for, nor use of, a flame stabilizer nor flow recirculation zone to stabilize the flame. Rather, stable flame and combustion are achieved by initial selling of fluid oxidant and, as needed during operation, modification of fuel supplied to the separately controlled fuel outlets. Another benefit of the present invention is that the pilot burner is able to operate at a lower fuel/oxidant ratio than conventional pilot burners. Specifically the present pilot burner is able to provide stable combustion at a fuel/oxidant ratio that may be as low as the fuel/oxidant ratio of the main burners. Also in contrast with other approaches, in various embodiments flow-balancing inserts are not required. Thus, elegant solutions are achieved toward design of a pilot burner that has a broad flow range between blow-off and flashback, and yet that also consistently achieves low-$NO_x$ combustion.

The appended figures and descriptions of them below are meant to be illustrative of aspects of the invention without being limiting.

Figure 1B:
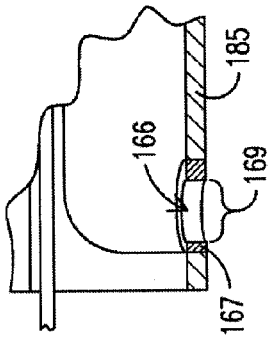
FIG. 1B shows a partial portion of FIG. 1A enlarged to depict the fluid-restricting inlet port of the inner mixing passage.
Figure 1A:
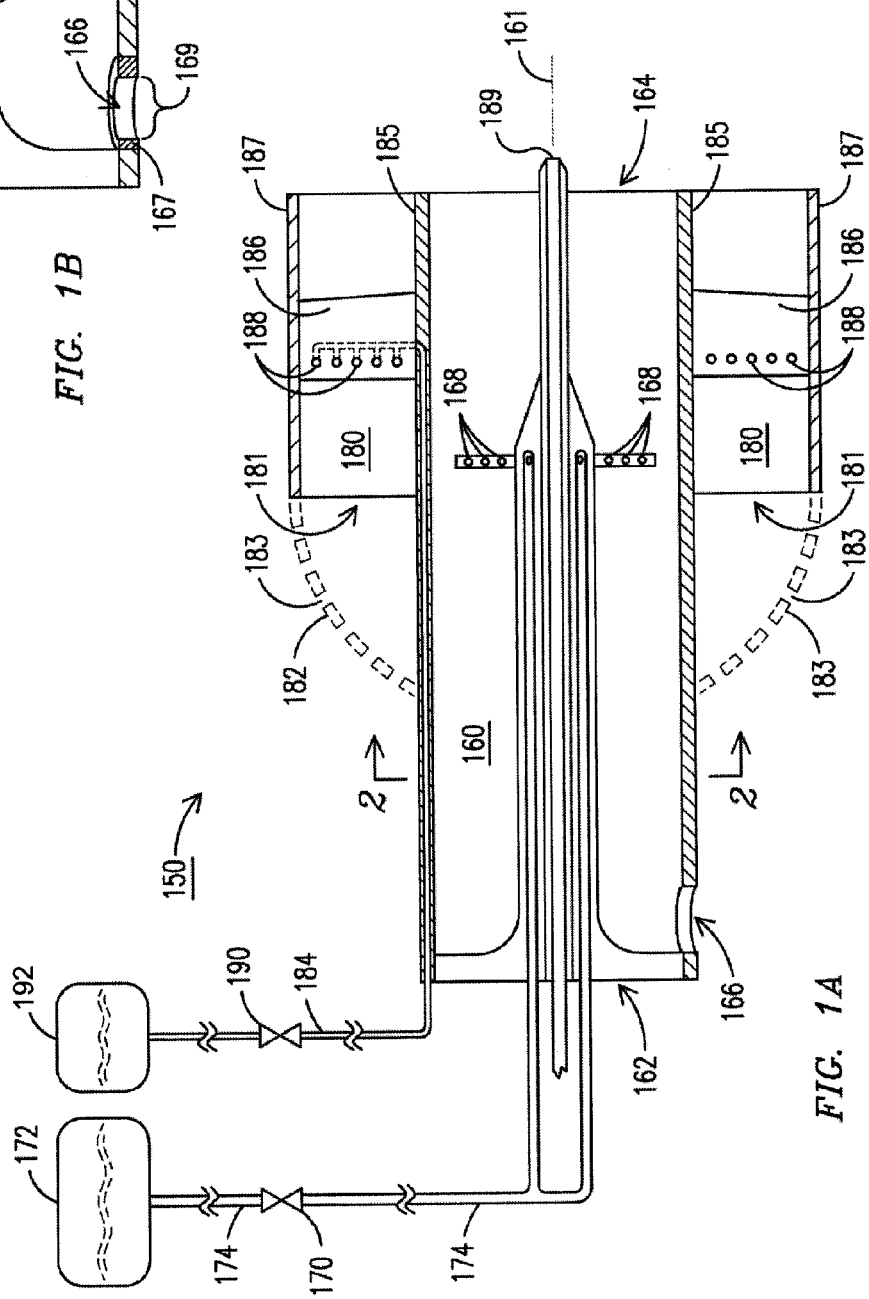
FIG. 1A provides a cross-sectional view of a gas turbine pilot burner embodiment depicting the fuel-profilable features of the present invention.

FIG. 1 provides a side cross-sectional view of an exemplary gas turbine fuel-profilable pilot burner 150 of the present invention. An inner mixing passage 160 is disposed about an axial flow axis 161 indicating the flow direction of fluid oxidizer through the pilot burner 150. The inner mixing passage 160 has an upstream end 162 and a downstream end 164, and includes, toward the upstream end 162, at least one fluid-restricting inlet port(s) 166 for providing a fluid oxidant, such as compressed air from a compressor (not shown). The inlet port(s) act to restrict flow velocity of the fluid oxidant so that the axial flow velocity of the fuel/oxidant mixture exiting the inner mixing passage 160 is lower than the axial flow velocity of the fuel/oxidant mixture exiting the annular outer mixing passage 180. At least one fuel outlet 168 is also disposed within the inner mixing passage 160. Fuel dispensed by these fuel outlets 168 is controlled by an inner fuel controller 170, which is between and in fluid communication with a fuel supply 172 and the plurality of fuel outlets 168 via a first fuel line 174.

The outer annular mixing passage 180 is disposed radially outwardly from the inner mixing passage 160. A cylindrical casing 185 separates the two mixing passages 160 and 180, and also supports at least one outer swirler element 186 disposed in the outer annular mixing passage 180. The other more outward ends of the outer swirler elements 186 are fixedly attached to an outer swirler casing 187. The swirler elements 186 are disposed at a desired angle transverse to the axial flow axis 161 so as to impart a desired swirl velocity (i.e. rotating about axis 161) to fluids passing the swirler elements 186.

Fluid oxidant, such as compressed air, enters the outer annular mixing passage 180 through an upstream annular port 181. Optionally, the port 181 may be flow-restricted such as by placement of an optional fluid-permeable cover 182. This may be a wire cloth, a wire screen, or plate with holes, or other cover that restricts flow but nonetheless allows a desired amount of fluid to pass through apertures 183 and then into the port 181 and into the outer annular mixing passage 180 to mix with fuel. Fuel may be supplied to outer annular mixing passage fuel outlet(s) 188 from a second fuel supply 192 via a second fuel line 184 that communicates with an outer fuel controller 190. These fuel outlets 188 are shown disposed along the outer swirler elements 186. However, this is not meant to be limiting, and more generally, outer annular mixing passage fuel outlets may be disposed anywhere in the outer annular mixing passage 180.

An optional diffusion fuel outlet 189 is also shown. It is noted that the specific features of this exemplary embodiment are not meant to be limiting. For example, instead of the swirler elements 186, other structures may be employed to provide a desired flow pattern.

During an exemplary operation, compressed air, as an exemplary fluid oxidant, enters the inner mixing passage 160 through at least one fluid-restricting inlet port 166, and fluid oxidant also enters the outer annular mixing passage 180 through port 181. The optional fluid-permeable cover 182 may be set into place over the port 181 by means known in the art, such as spot welding, during operational down times if it is determined after a period of operation that operations would be enhanced with relatively less flow entering the outer annular mixing passage 180. The percent open area may be varied in this optional fluid-permeable cover 182, and may be set, for example, between 10 percent and 90 percent, or between 30 percent and 60 percent, or any ranges therein.

Analogously, the inlet port(s) 166 may be further restricted, as may be determined to be desired after a period of operation, by inserting optional inserts 167 having a desired open area 169. These optional inserts 167 act to further restrict the flow velocity of the oxidant, thereby further reducing the axial flow velocity of the fuel/oxidant mixture exiting the inner mixing passage 160. Optional inserts 167 may be affixed by spot welding or other methods of attachment known to those skilled in the art. Thus, the oxidant flow rates through each of the passages 160, 180 may be tailored for a particular application, either before initial operation or after a period of operation where application-specific data is gathered and is then used to determine optimal oxidant flow rates.

Because in various embodiments there are independently controllable fuel supplies to the inner and the outer annular mixing passages, such pilot burners are considered fuel-profilable. In other words, the fuel profile of the fuel/oxidant mixture exiting the inner mixing passage may have a first fuel concentration (equivalence ratio) while the fuel profile of the fuel/oxidant mixture exiting the outer annular mixing passage may have a second, different fuel concentration (equivalence ratio), and these concentrations may be different from each other and may be varied. For example, the mixture may be leaner in the inner mixing passage than in the outer passage. As these different mixtures move further downstream and the effect of the relatively narrow but strong swirl of the outer annular mixing passage results in an outward substantially conical spreading pattern, as will be described more fully below, the relative fuel concentrations in the respective fuel/oxidizer mixtures provide for flexibility that may lead to more stable and clean operation.

For comparative purposes, it is noted that the overall swirl number of a conventional swirler assembly may be in the range of 0.65 to 0.7. In embodiments of the present invention the overall swirl number may be lower, about 0.4 to 0.5, however there is a narrow annular region of relatively stronger swirl, coming from the outer annular mixing passage due to the presence of at least one swirler element, that is effective to establish, further downstream in the pilot flame zone, a narrow strong swirl zone between unburned and burned fuel/oxidant mixtures to create a shear layer that continuously mixes the unburned and burned fuel/oxidant mixtures. Lower swirl of the mixture flowing from the inner mixing passage reduces the overall swirl number of the fuel-profilable pilot burner of the present invention.

Further, in various embodiments, the inner mixing passage 160 lacks a flow balancing insert. This is the case for the embodiment of FIG. 1 discussed above. This is not meant to be limiting, however, and embodiments of the present invention may further include a flow balancing insert. Such flow balancing insert may provide additional restriction of flow through one of the mixing passages. Flow balancing inserts are not necessary because of the presence of the fluid-restricting inlet port(s) 166, which already act to restrict flow velocity of the oxidant. If present, such flow balancing insert may be constructed of materials known to those skilled in the art. Those teachings include construction of a flow balancing insert of metal, plastic, or other rigid material in which holes are provided, and may include wire mesh or cloth, and wherein the closed area ranges from about 50 to 85 percent. However, in the present embodiments, in view of the primary restriction to the inner mixing passages by at least one fluid-restricting inlet port, in various embodiments the total closed area of such optional flow restricting inserts may range from 5 to 50 percent, and any subranges therein. Also, in the present embodiments, in view of the optional restriction to the outer annular mixing passages 180 by the optional fluid-permeable cover(s) 182, in various embodiments the total closed area of such optional flow restricting inserts placed in an outer annular mixing channel similarly may range from 5 to 50 percent, and any subranges therein.

Figure 2:
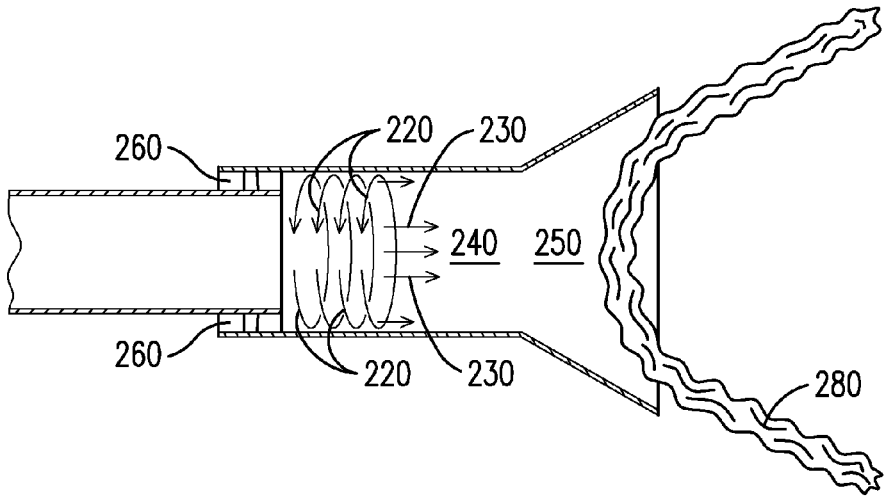
FIG. 2 provides a schematic view of the straight and expanding sections of a pilot cone.

In one particular embodiment, meant to be illustrative and not limiting, a relatively narrow strong swirl zone is established between the unburned and burned mixtures to create a shear layer that continuously mixes the unburned and burned fuel/oxidant mixtures. This keeps the flame ignited while minimizing undesired regions of recirculation and/or high fuel/oxidant ratio and consequent undesired elevated $NO_x$ emissions FIG. 2 shows a schematic view of the straight and expanding sections of a pilot burner showing its pilot cone. In this embodiment the outer swirling fuel/oxidant mixture flow 220 concentrically entrains the center non-swirling fuel/oxidant mixture flow 230, transferring some angular momentum as the concentric flows proceed through the straight section 240. This angular momentum transfer continues as the concentric flows proceed through the expanding section 250. The angular momentum causes the concentric flows to radially expand against the outer wall of the expanding section 250 as it flows axially downstream. By having the appropriate amount of angular momentum and the appropriate ratio of air flow in the outer annular mixing passage 260 relative to air flow in the inner mixing passage 270, there will be a smoothly diverging flow field in the expanding section 250 with no recirculation zone. As the concentric flows expand in the expanding section 250, also called the cone, the axial flow velocity decreases. The flame 280 stabilizes at the location where the turbulent flame speed equals the local flow velocity. This creates a stable, robust pilot flame 280 that is generally U-shaped as viewed in section as in FIG. 2. The outer edges of this pilot flame provide an ignition source for the main fuel/air mixture.

Figure 3:
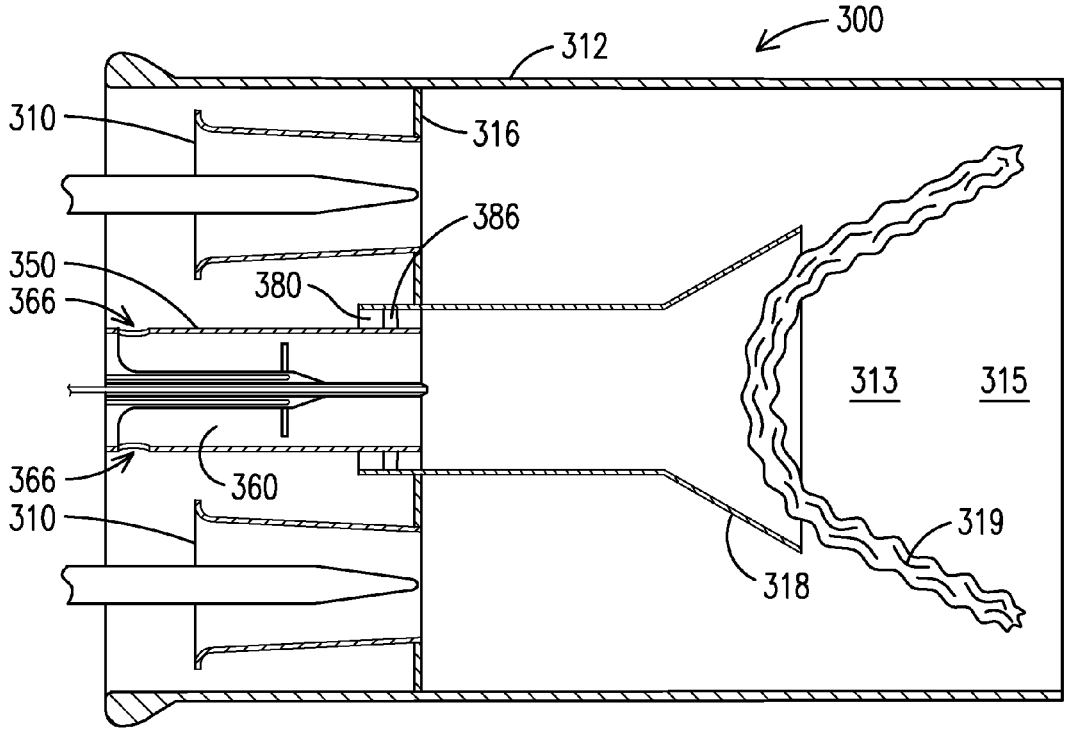
FIG. 3 provides a schematic view of a combustor embodiment depicting one embodiment of a fuel-profilable pilot burner feature of the present invention.

FIG. 3 provides a schematic view of a combustor 300 including another embodiment of a fuel-profilable pilot burner 350 of the present invention between annularly disposed main swirler assemblies (burners) 310. A casing 312 defines a space that includes a pilot flame zone 313 and a main combustion zone 315. A base plate 316 establishes an upstream barrier of such zones. Generally, a pilot cone 318 partly restricts flow from the main swirler assemblies 310 and also helps determine the flame pattern for the pilot flame. Without being bound to a particular theory, in various embodiments the angle and length of the pilot cone affects the pilot flame and its stability under various operational conditions. A particular flame pattern 319 is shown. This generally U-shaped flame pattern is expected when the axial velocity of a fuel/air mixture from the inner mixing passage 360 is relatively lower and has relatively lower swirl when compared with those parameters of the fuel/air mixture from the outer annular mixing passage 380, which per above, may provide a narrow region of high swirl based on the presence of swirler elements 386. This embodiment is not meant to be limiting.

FIG. 3 also exemplifies that there may be more than one fluid-restricting inlet port 366 in a particular fuel-profilable pilot burner 350. The fluid-restricting inlet ports may be spaced apart circumferentially as suggested by this figure.

Figure 4:
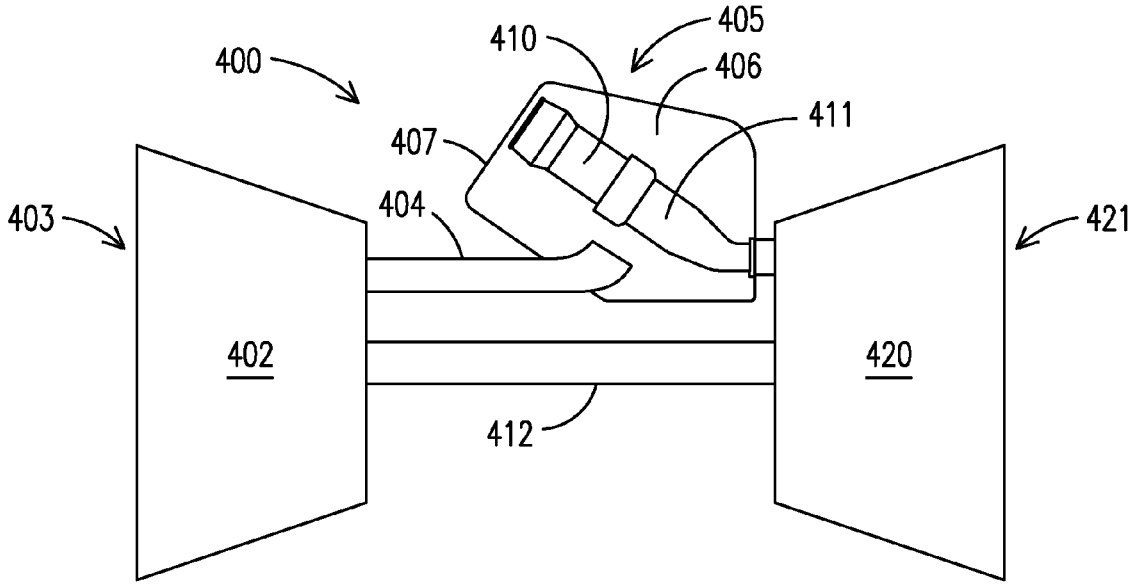
FIG. 4 is a schematic lateral cross-sectional depiction of a gas turbine engine incorporating aspects of the present invention.

Embodiments of the present invention are used in gas turbine engines such as are represented by FIG. 4, which is a schematic lateral cross-sectional depiction of a gas turbine 400 showing major components. Gas turbine engine 400 comprises a compressor 402 at an upstream end 403 of the machine, a turbine 420 at a downstream end 421 interconnected by shaft 412, and a mid-frame section 405 disposed there between. The mid-frame section 405, defined in part by a casing 407 that encloses a plenum 406, includes within the plenum 406 a combustor 410 and a transition 411. During operation, in generally axial flow series, compressor 402 takes in air and provides compressed air to an annular diffuser 404, which passes the compressed air to the plenum 406 through which the compressed air passes to the combustor 410, which mixes the compressed air with fuel (not shown, but see disclosure above), providing hot combusted gases via the transition 411 to the turbine 420, whose rotation may be used to power the compressor and to provide shaft power such as may be used to generate electricity. It is appreciated that the plenum 406 is an annular chamber that may hold a plurality of circumferentially spaced apart combustors 410, each associated with a downstream transition 411. Likewise the annular diffuser 404, which connects to but is not part of the mid-frame section 405, extends annularly about the shaft 412. Embodiments of the present invention may be incorporated into each combustor (such as 410) of a gas turbine engine to achieve the indicated benefits.

All patents, patent applications, patent publications, and other publications referenced herein are hereby incorporated by reference in this application in order to more fully describe the state of the art to which the present invention pertains, to provide such teachings as are generally known to those skilled in the art.

While various embodiments of the present invention have been shown and described herein, it will be obvious that such embodiments are provided by way of example only. Numerous variations, changes and substitutions may be made without departing from the invention herein. Moreover, when any range is described herein, unless clearly stated otherwise, that range includes all values therein and all subranges therein. Accordingly, it is intended that the invention be limited only by the spirit and scope of the appended claims.

The invention claimed is:

1. A pilot burner for a gas turbine engine comprising:

an annular inner casing disposed within an annular outer casing, the inner casing defining an inner mixing passageway, and a space between the inner casing and outer casing defining an annular outer mixing passageway;

an inlet to the outer casing in fluid communication with a compressed air source for admitting an outer fluid oxidant flow into the outer mixing passageway;

a fluid-restricting inlet port in fluid communication with the compressed air source for admitting a restricted inner fluid oxidant flow into the inner mixing passageway, the fluid-restricting inlet port effective to limit the inner fluid oxidant flow to have an axial velocity through the inner mixing passageway that is less than an axial velocity of the outer fluid oxidant flow through the outer mixing passageway;

a swirler element disposed in the outer mixing passageway effective to impart an annular swirl velocity to the outer fluid oxidant flow;

an inner fuel outlet delivering an inner fuel flow into the inner fluid oxidant flow within the inner mixing passageway to provide a non-swirling inner fuel/oxidant mixture flow at an outlet end of the inner casing;

an outer fuel outlet delivering an outer fuel flow into the outer fluid oxidant flow within the outer mixing passageway to provide a swirling outer fuel/oxidant mixture flow surrounding and concentric with the inner fuel/oxidant mixture flow at the outlet end of the inner casing;

the outer casing extending in a downstream direction beyond the outlet end of the inner casing to define a straight section mixing zone, the straight section mixing zone receiving the concentric flows and effective to allow the swirling outer fuel/oxidant mixture flow to impart a degree of angular momentum to the inner fluid fuel/oxidant mixture flow as the concentric flows progress axially toward an open end of the straight section mixing zone; and a cone disposed at the open end of the straight section mixing zone for receiving and radially expanding the concentric flows;

wherein the angular swirl velocity of the outer fuel/oxidant mixture flow cooperates with the cone to expand the concentric flows radially against the cone and to reduce an axial velocity of the inner fuel/oxidant mixture flow as it flows through the cone sufficiently to enable the concentric flows to burn without recirculation flow and without attachment to any structure of the pilot burner.

2. The pilot burner of claim 1, further comprising separately controllable fuel supplies in fluid communication with the inner and outer fuel outlets respectively.

3. The pilot burner of claim 1, further comprising an insert disposed within the fluid-restricting inlet port effective to restrict the inner fluid oxidant flow to a desired flow rate relative to the outer fluid oxidant flow.

4. The pilot burner of claim 1, further comprising a fluid-permeable cover disposed over the inlet to the outer casing.

5. The pilot burner of claim 1, wherein an overall swirl number is in a range of 0.4 to 0.5.

6. The pilot burner of claim 1, wherein an equivalence ratio of the inner fuel/oxidant mixture is different than an equivalence ratio of the outer fuel/oxidant mixture.

7. A pilot burner for a gas turbine engine comprising:

a swirler for providing a swirling outer fuel/oxidant mixture flow concentric with a non-swirling inner fuel/oxidant mixture flow to a straight section mixing zone, the straight section mixing zone effective to allow the swirling outer fuel/oxidant mixture flow to impart a degree of angular momentum to the inner fuel/oxidant mixture flow as the concentric flows move through the straight section mixing zone;

a means for individually controlling respective equivalence ratios of the inner fuel/oxidant mixture flow and outer fuel/oxidant mixture flow;

a cone disposed at a downstream end of the straight section mixing zone for receiving the concentric flows; and an angular swirl velocity of the swirling outer fuel/oxidant mixture flow being effective to expand the concentric flows radially against the cone and to reduce an axial velocity of the inner fuel/oxidant mixture flow as it flows through the cone sufficiently to enable the concentric flows to burn as a generally U-shaped pilot flame without a recirculation flow zone.

8. The pilot burner of claim 7, further comprising a means for restricting a flow of oxidant forming the inner fuel/oxidant mixture flow effective to provide an axial velocity of the inner fuel/oxidant mixture flow that is less than an axial velocity of the outer fuel/oxidant mixture flow through the straight section mixing zone and cone.

* * * * *